US008141457B2

(12) United States Patent
Chu et al.

(10) Patent No.: US 8,141,457 B2
(45) Date of Patent: Mar. 27, 2012

(54) POWER TRANSMISSION SWITCHING MECHANISM FOR OFFICE MACHINE

(75) Inventors: Chung-Kung Chu, Taipei (TW); Ming-Hsiung Ding, Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 422 days.

(21) Appl. No.: 12/379,897

(22) Filed: Mar. 4, 2009

(65) Prior Publication Data

US 2010/0139430 A1 Jun. 10, 2010

(30) Foreign Application Priority Data

Dec. 5, 2008 (TW) ..... 97147282 A

(51) Int. Cl.
*F16H 37/06* (2006.01)

(52) U.S. Cl. ..... 74/665 F; 74/352; 74/405; 74/417; 358/471; 358/474; 358/497

(58) Field of Classification Search ..... 74/665 F, 74/352

See application file for complete search history.

(56) References Cited

U.S. PATENT DOCUMENTS

| | | | | |
|---|---|---|---|---|
| 4,302,095 | A * | 11/1981 | Calabrese | 399/213 |
| 7,306,216 | B2 * | 12/2007 | Lee et al. | 271/10.01 |
| 7,536,129 | B2 * | 5/2009 | Lee et al. | 399/88 |
| 7,669,496 | B2 * | 3/2010 | Takahashi | 74/405 |
| 7,934,784 | B2 * | 5/2011 | Koga et al. | 347/16 |
| 2004/0057071 | A1 * | 3/2004 | Lin et al. | 358/1.15 |
| 2009/0284565 | A1 * | 11/2009 | Shinagawa et al. | 347/37 |
| 2010/0045715 | A1 * | 2/2010 | Takeuchi et al. | 347/9 |
| 2010/0045724 | A1 * | 2/2010 | Toki | 347/16 |

* cited by examiner

*Primary Examiner* — David D Le
*Assistant Examiner* — Jacob S Scott
(74) *Attorney, Agent, or Firm* — Jianq Chyun IP Office

(57) ABSTRACT

A power transmission switching mechanism for office machine is provided. The power transmission switching mechanism has simple structure and enables the office machine to commonly use a motor to execute scanning and printing works. The power transmission switching mechanism includes a rotary shaft, a drive gear mounted on the rotary shaft, an actuator reciprocally movable on the rotary shaft and a driving gear for transmitting power of a motor to the drive gear. The drive gear has a spline. The actuator can be selectively moved forward or backward to make the spline disengaged from a first gear mounted on the rotary shaft or engaged with the first gear. When the spline is disengaged from the first gear, the power of the motor is transmitted to a scanning module. When the spline is engaged with the first gear, the power of the motor is transmitted to the rotary shaft for printing work.

18 Claims, 20 Drawing Sheets

POWER TRANSMISSION SWITCHING MECHANISM FOR OFFICE MACHINE

BACKGROUND OF THE INVENTION

The present invention is related generally to a power transmission switching mechanism, and more particularly to a power transmission switching mechanism for office machine. With the power transmission switching mechanism, an office machine can use a common motor to execute printing and scanning works.

A conventional office machine includes a power transmission mechanism for transmitting power to execute printing or scanning work. There are various commercially available office machines each including two motors for driving scanning and printing mechanisms respectively. For example, FIG. 1 shows a typical power transmission mechanism composed of ten to twenty gears. Two motors M1, M2 are used to supply power for the printing and scanning works respectively.

Since the motors will lead to higher cost of the office machine, some manufacturers have tried to develop some power transmission mechanisms to reduce the number of the motors. For example, FIGS. 2 and 3 show a power transmission mechanism composed of several decades of gears. By means of operating a lever L and changing its position, the power of a common motor can be switched between a printing mode and a scanning mode for executing printing and scanning works respectively. However, such power transmission mechanism includes numerous gears and has complicated structure.

It is therefore tried by the applicant to provide a power transmission switching mechanism for office machine, which is designed with improved power transmission pattern and has less gears and simplified structure to lower cost.

SUMMARY OF THE INVENTION

It is therefore a primary object of the present invention to provide a power transmission switching mechanism for office machine. The power transmission switching mechanism has simple structure and enables the office machine to commonly use a motor to execute scanning and printing works. The power transmission switching mechanism includes a rotary shaft for feeding papers, a drive gear mounted on the rotary shaft, an actuator reciprocally movable on the rotary shaft and a driving gear for transmitting power of a motor to the drive gear. The drive gear has an internal spline. The actuator can be selectively moved forward or backward to make the internal spline disengaged from a first gear mounted on the rotary shaft or engaged with the first gear. When the internal spline is disengaged from the first gear, the power of the motor is transmitted to a scanning module. When the internal spline is engaged with the first gear, the power of the motor is transmitted to the rotary shaft for printing work.

It is a further object of the present invention to provide the above power transmission switching mechanism for office machine, in which when the actuator moves forward, the actuator pushes the drive gear. The drive gear includes a second gear section. When pushed by the actuator, the second gear section is engaged with a driven gear to transmit the power of the motor to the scanning module.

It is still a further object of the present invention to provide the above power transmission switching mechanism for office machine, in which the drive gear includes a front end face and a rear end face. The front end face faces the actuator and is pushable by the actuator. The rear end face abuts against a spring. When the actuator moves forward to push the drive gear, the drive gear will compress the spring to conserve energy. When the actuator moves backward away from the drive gear, the spring will release the energy to push the drive gear back to its home position or a set position.

It is still a further object of the present invention to provide the above power transmission switching mechanism for office machine, in which a shifter is positioned between the actuator and the drive gear. The shifter includes a first section, a seat body and a second section. The first section is positioned between the actuator and the seat body and the second section is positioned between the seat body and the drive gear. When the actuator moves forward, the first section is pushed by the actuator into the seat body. At this time, the first section pushes the second section to move in a direction away from the seat body to push the drive gear. Accordingly, the drive gear is engaged with the driven gear to transmit the power of the motor to the scanning module.

The present invention can be best understood through the following description and accompanying drawings wherein:

DETAILED DESCRIPTION OF THE PREFERRED EMBODIMENTS

Figure 1:
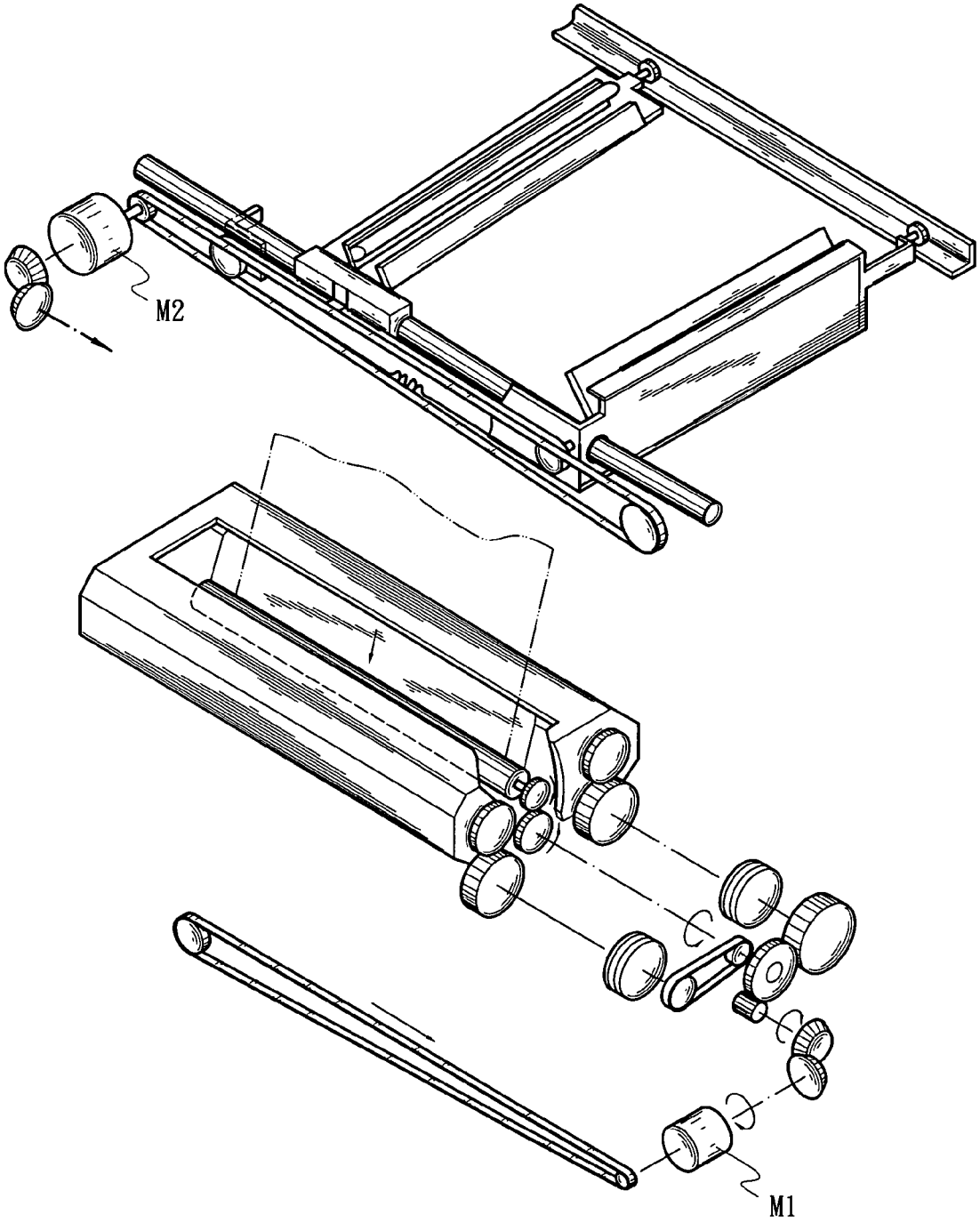
Fig. 1 PRIOR ART
FIG. 1 shows a conventional power transmission mechanism of an office machine.
Figure 2:
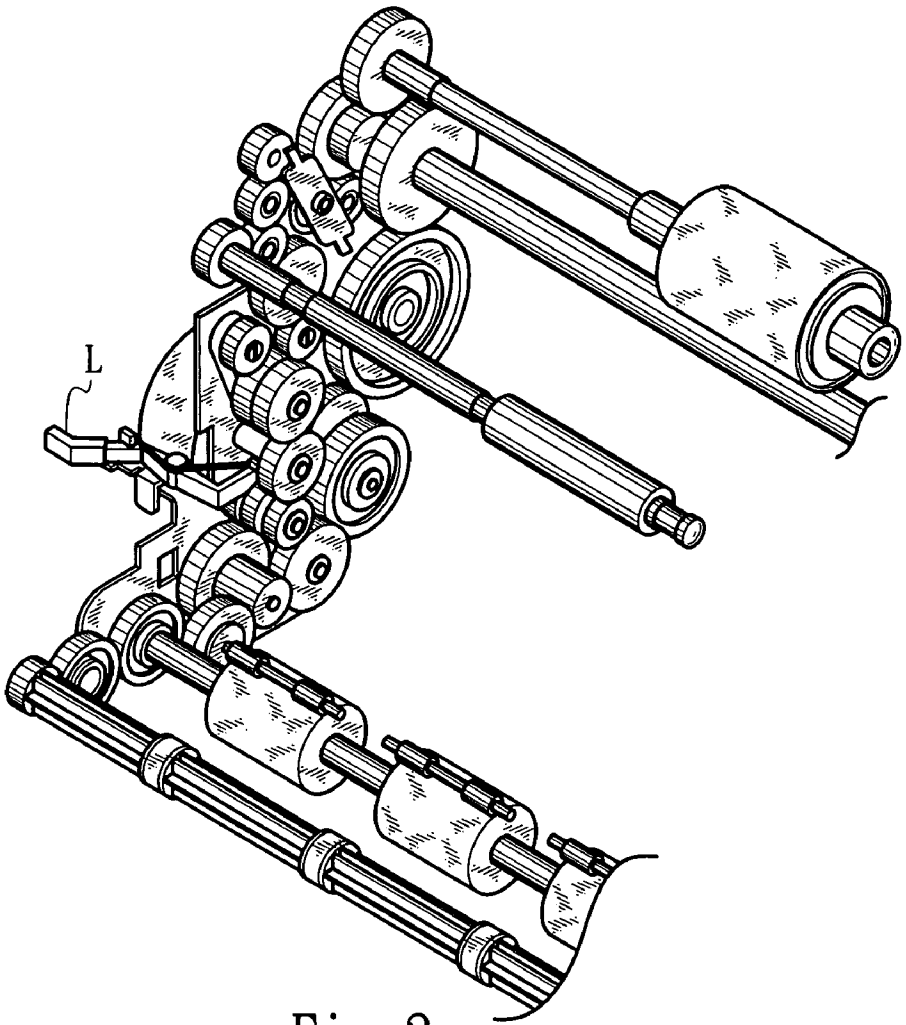
Fig. 2 PRIOR ART
FIG. 2 shows another conventional power transmission mechanism of an office machine.
Figure 3:
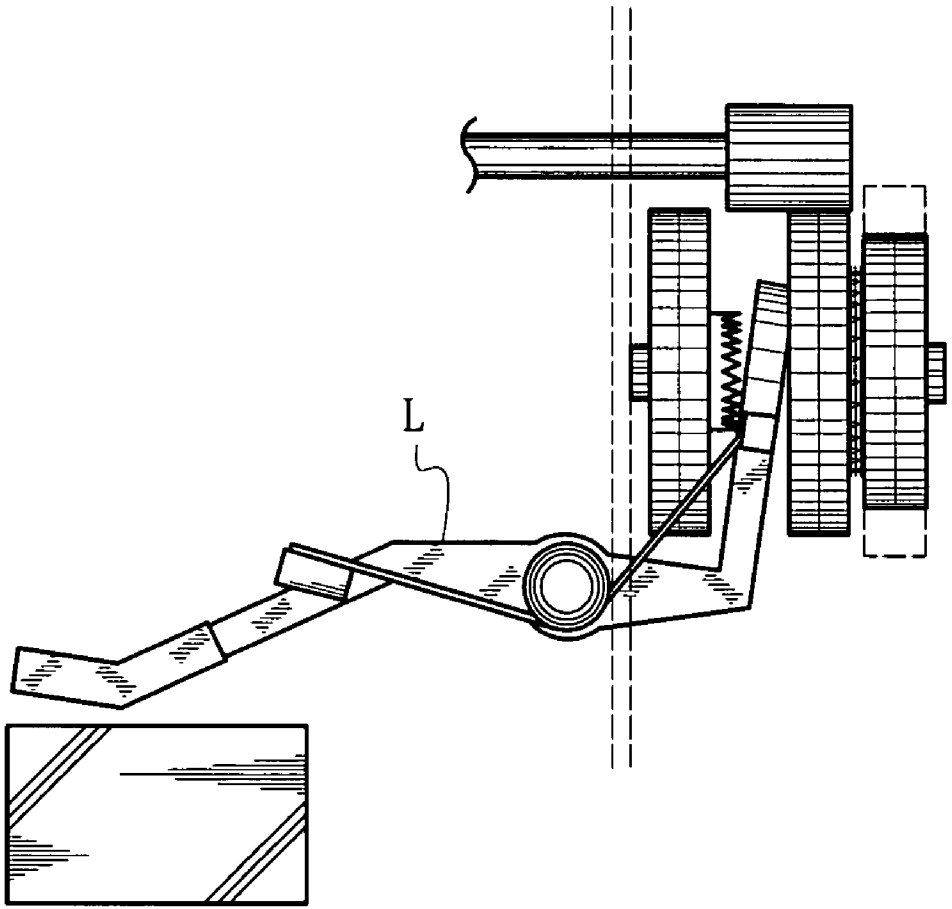
Fig. 3 PRIOR ART
FIG. 3 is a sectional view of a part of the conventional power transmission mechanism according to FIG. 2.
Figure 4:
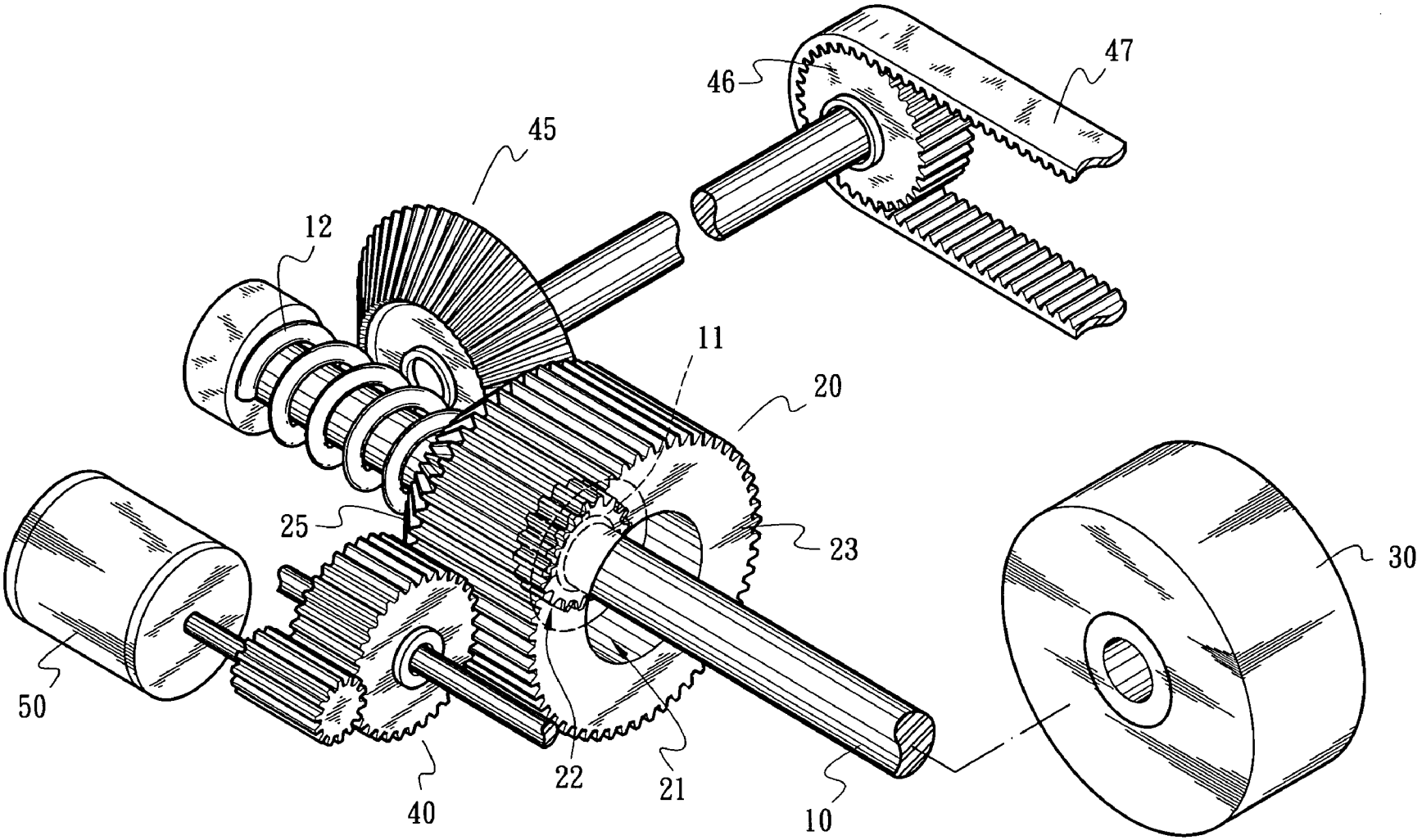
FIG. 4 is a perspective view of a first embodiment of the power transmission switching mechanism for office machine of the present invention.
Figure 5:
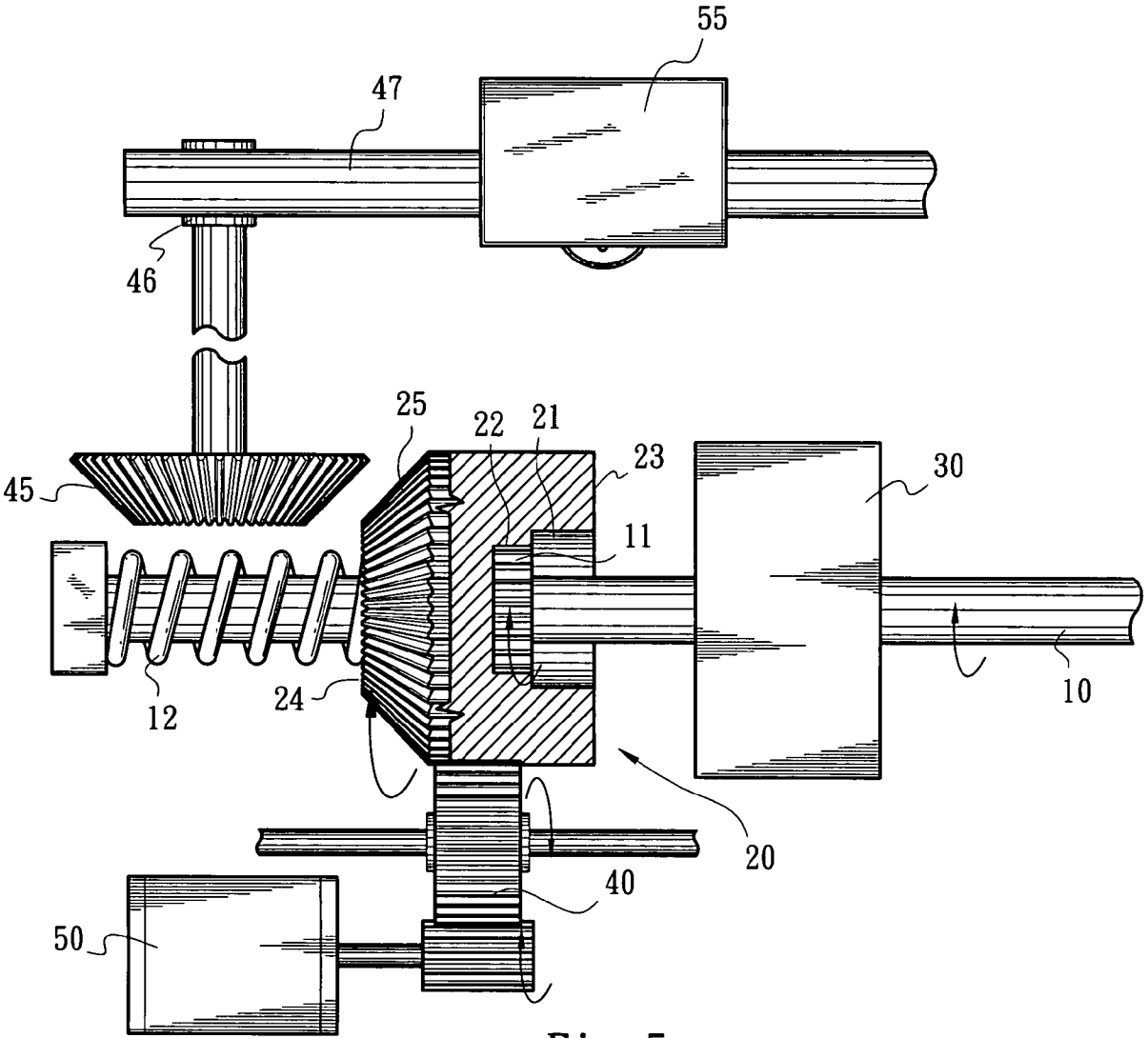
FIG. 5 is a sectional view of the first embodiment of the power transmission switching mechanism for office machine of the present invention, showing that the drive gear is engaged with the first gear of the rotary shaft.

Please refer to FIGS. 4 and 5. According to a first embodiment, the power transmission switching mechanism for office machine of the present invention includes a rotary shaft 10 having a first gear 11 mounted thereon, a drive gear 20 mounted on the rotary shaft 10, an actuator 30 reciprocally movable on the rotary shaft 10 and a driving gear 40 for transmitting power of a motor 50 to the drive gear 20. The rotary shaft 10 serves to feed papers for printing operation. The actuator 30 can be driven with a belt (not shown) under control of a circuit.

Preferably, the drive gear 20 has a cavity 21 and an internal spline 22 formed in the cavity 21. In response to the reciprocation of the actuator 30, the internal spline 22 can selectively disengage from the first gear 11 or engage therewith. (This will be further described hereinafter with reference to FIGS. 6 and 7.) When the internal spline 22 is engaged with the first gear 11, the power of the motor 50 is transmitted to the rotary shaft 10 for paper feeding and printing work. On the other hand, when the internal spline 22 is disengaged from the first gear 11, the power of the motor 50 is transmitted to a scanning module 55.

FIGS. 4 and 5 show that the motor 50 is engaged with the driving gear 40, the driving gear 40 is engaged with the drive gear 20 and the first gear 11 is engaged with the internal spline 22. Accordingly, when the motor 50 operates, the power of the motor 50 is transmitted through the driving gear 40, the drive gear 20 and the first gear 11 to the rotary shaft 10. Under such circumstance, the rotary shaft 10 will rotate to execute paper feeding and printing operations.

The drive gear 20 includes a second gear section 25, a front end face 23 and a rear end face 24. The front end face 23 faces the actuator 30 and is pushable by the actuator 30. The rear end face 24 abuts against a spring 12. When the actuator 30 moves forward to push the drive gear 20, the drive gear 20 will compress the spring 12 to conserve energy. When the actuator 30 moves backward away from the drive gear 20, the spring 12 will release the energy to push the drive gear 20 back to its home position or a set position.

In this embodiment, the second gear section 25 of the drive gear 20 has the form of a bevel gear. When the actuator 30 moves forward, the drive gear 20 is pushed to make the second gear section 25 engaged with a driven gear 45. Under such circumstance, the power of the motor 50 is transmitted to the scanning module 55. The driven gear 45 also has the form of a bevel gear corresponding to the second gear section 25. Preferably, a pulley 46 is connected to one end of the driven gear 45 for driving a belt 47, which in turn drives the scanning module 55.

Figure 6:
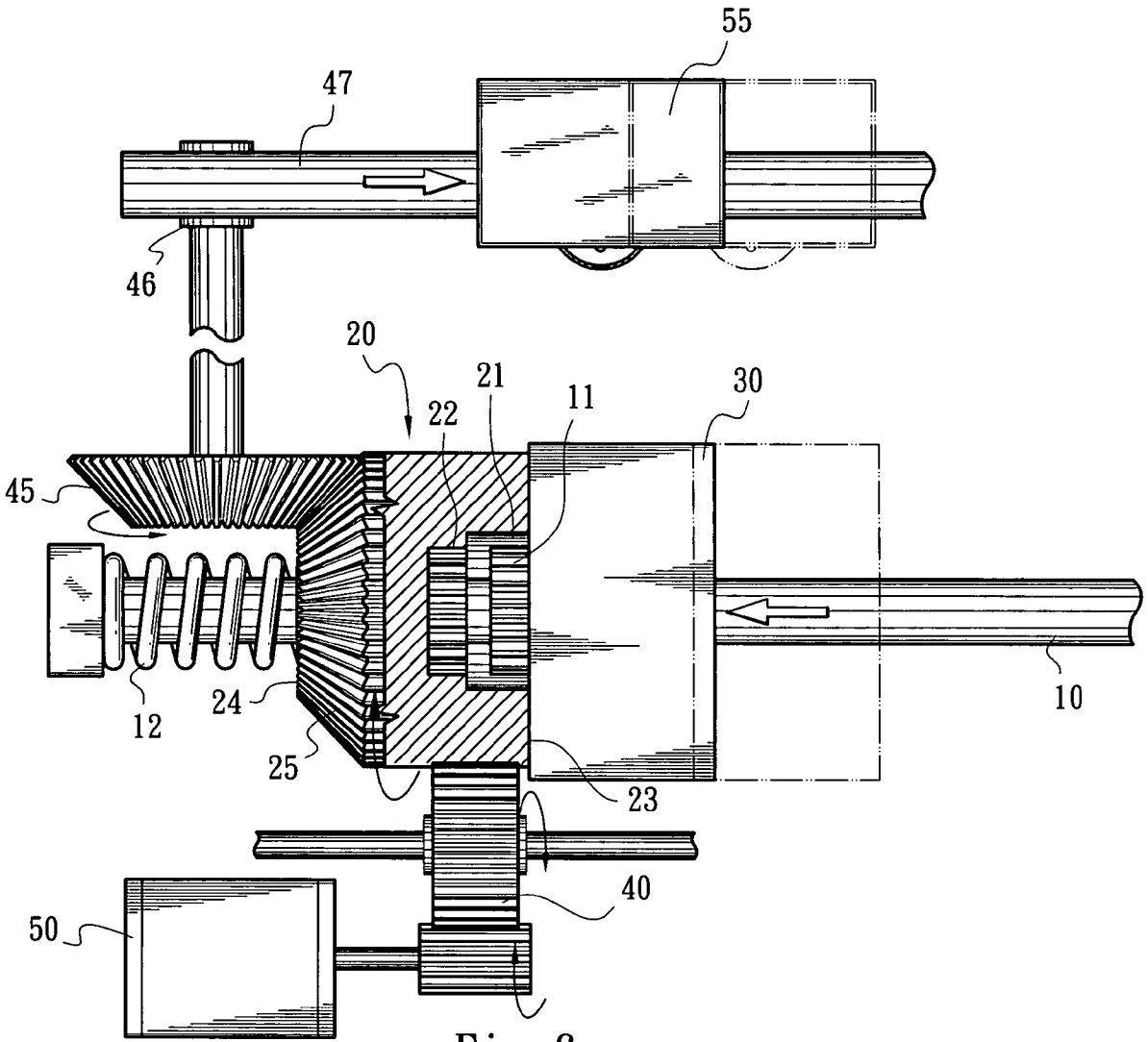
FIG. 6 is a sectional view according to FIG. 5, showing that the actuator is moved leftward.
Figure 7:
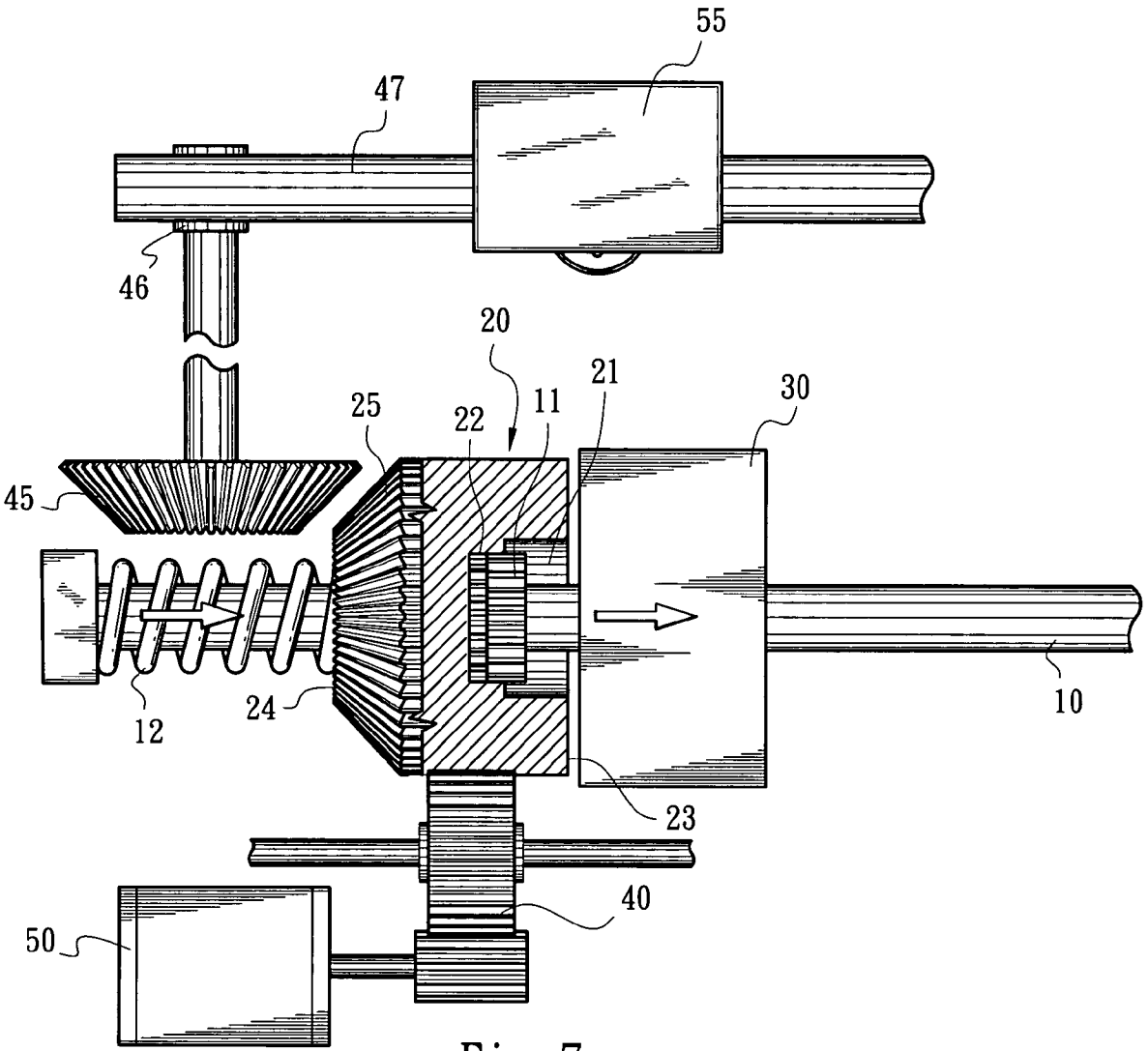
FIG. 7 is a sectional view according to FIG. 6, showing that the spring releases the conserved energy to push and move the drive gear rightward.

Please now refer to FIGS. 6 and 7. In this embodiment, the motor 50 can be first turned off. When the actuator 30 moves leftward (in a direction of the arrow in FIG. 6), the drive gear 20 is pushed leftward, whereby the second gear section 25 is engaged with the driven gear 45. At the same time, the rear end face 24 of the drive gear 20 compresses the spring 12 to conserve energy. As shown in FIG. 6, when the drive gear 20 moves leftward, the first gear 11 of the rotary shaft 10 is disengaged from the internal spline 22 of the drive gear 20. Therefore, when the motor 50 operates, the power of the motor 50 is transmitted through the driving gear 40 and the second gear section 25 of the drive gear 20 to the driven gear 45. The driven gear 45 then drives the scanning module 55 to reciprocate and execute scanning operation. In the above operation, the first gear 11 of the rotary shaft 10 is disengaged from the internal spline 22 so that the rotary shaft 10 will not rotate.

Referring to FIG. 7, with the motor 50 turned off, when the actuator 30 moves rightward and the drive gear 20 is released from the pushing force, the spring 12 will release the conserved energy to push the drive gear 20 back to its home position. At this time, the drive gear 20 is disengaged from the driven gear 45 and the first gear 11 of the rotary shaft 10 is engaged with the internal spline 22 of the drive gear 20 again. In this case, when the motor 50 operates, the power of the motor 50 is transmitted through the driving gear 40 and the drive gear 20 to the first gear 11. Under such circumstance, the rotary shaft 10 is rotated to execute paper feeding and printing operations. According to the above arrangement, the actuator 30 can be selectively moved forward or backward to make the drive gear 20 engaged with the driven gear 45 or the first gear 11. Accordingly, the power of the motor 50 can be switched between a printing mode and a scanning mode for executing printing and scanning works respectively.

Figure 8:
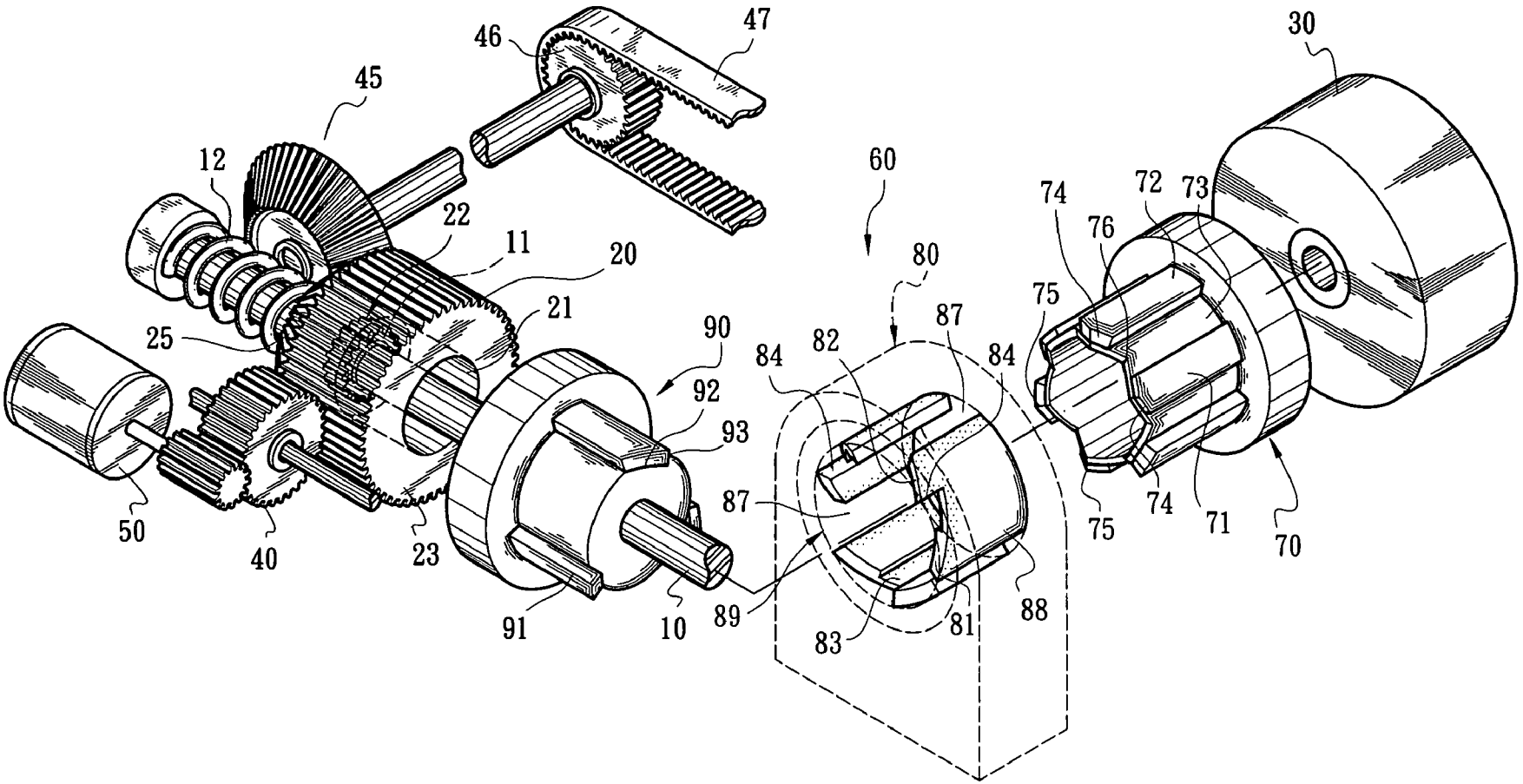
FIG. 8 is a perspective exploded view of a second embodiment of the power transmission switching mechanism for office machine of the present invention.
Figure 9:
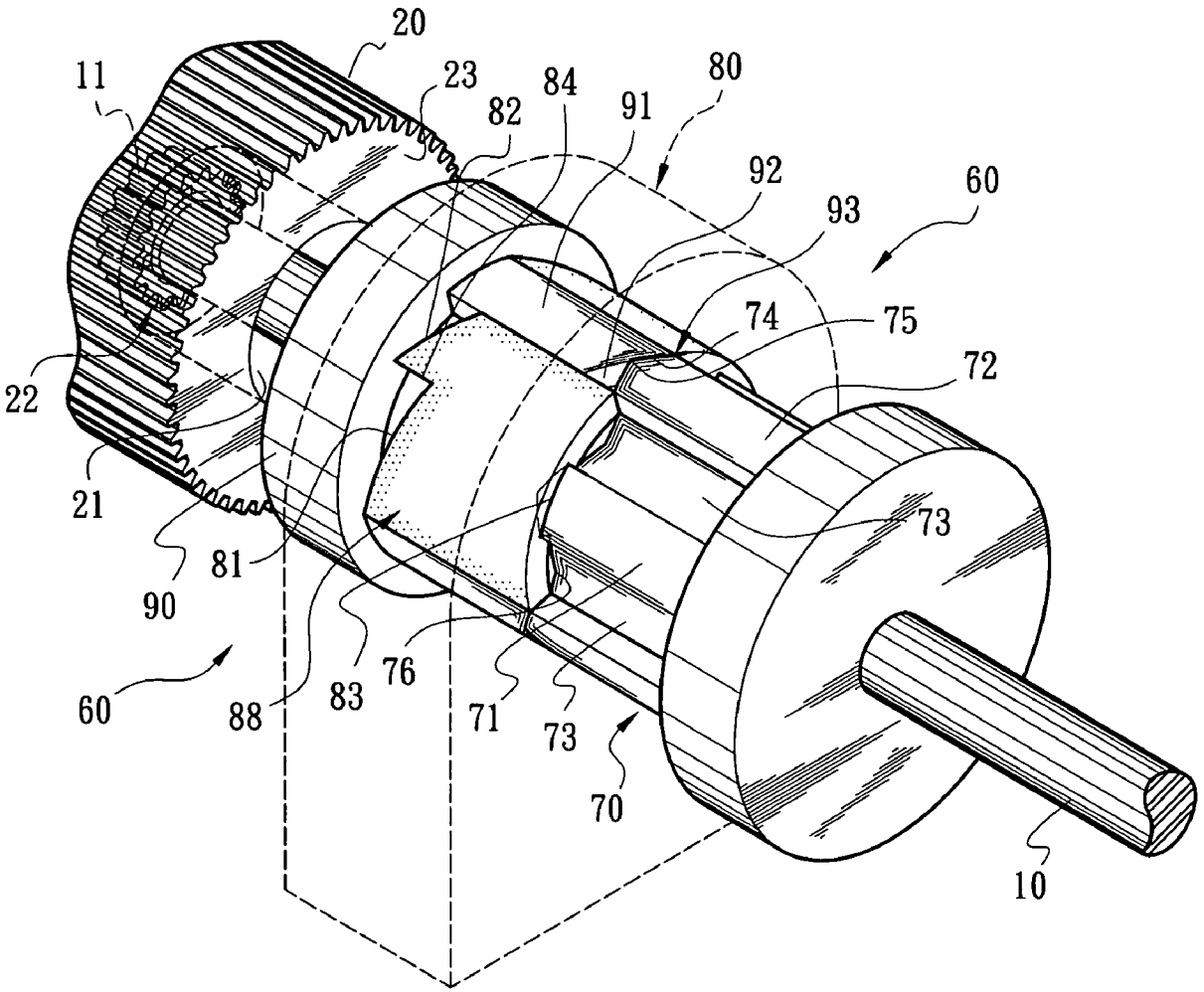
FIG. 9 is a perspective assembled view of the second embodiment of the power transmission switching mechanism for office machine of the present invention.

FIGS. 8 and 9 show a second embodiment of the present invention. In this embodiment, a shifter 60 is disposed on the rotary shaft 10. The shifter 60 is positioned between the actuator 30 and the drive gear 20. The shifter 60 includes a first section 70, a seat body 80 and a second section 90. The first section 70 is positioned between the actuator 30 and the seat body 80 and the second section 90 is positioned between the seat body 80 and the drive gear 20. In response to the movements of the actuator 30 and the drive gear 20, the first and second sections 70, 90 can move into or out of the seat body 80.

As shown in FIG. 8, the first section 70 is formed with a configuration like a hub. The first section 70 has multiple pillow blocks 71 and multiple island blocks 72, which extend along an axis of the first section 70. The pillow blocks 71 and the island blocks 72 define multiple trenches 73 therebetween. Each pillow block 71 has a ridge section 74 and a crest 75. Also, each island block 72 has a ridge section 74 and a crest 75. A trough 76 is formed at a front end of each trench 73.

In this embodiment, the seat body 80 is formed with a through hole 89. Multiple interference sections 88 are formed on a wall of the through hole 89 at intervals. Each interference section 88 is formed with a channel 83 within which the pillow section 71 of the first section 70 is movable. Each two adjacent interference sections 88 define a rail 87 therebetween. The island block 72 of the first section 70 is movable within the rail 87. Each interference section 88 at least has an irregular end face formed with a first face 81 and a second face 82. Preferably, with an axial direction of the seat body 80 as a reference direction, the second face 82 is positioned at a length longer than that of a rear end of the first face 81. Accordingly, a shoulder section 84 is formed between the first and second faces 81, 82.

FIG. 8 also shows that the second section 90 is formed with a configuration like a projecting shaft. The second section 90 has multiple island blocks 91 extending along an axis of the second section 90. The island blocks 91 are movable within the rails 87 of the seat body 80. In this embodiment, each island block 91 has a slope 92 and a top end 93.

Figure 10:
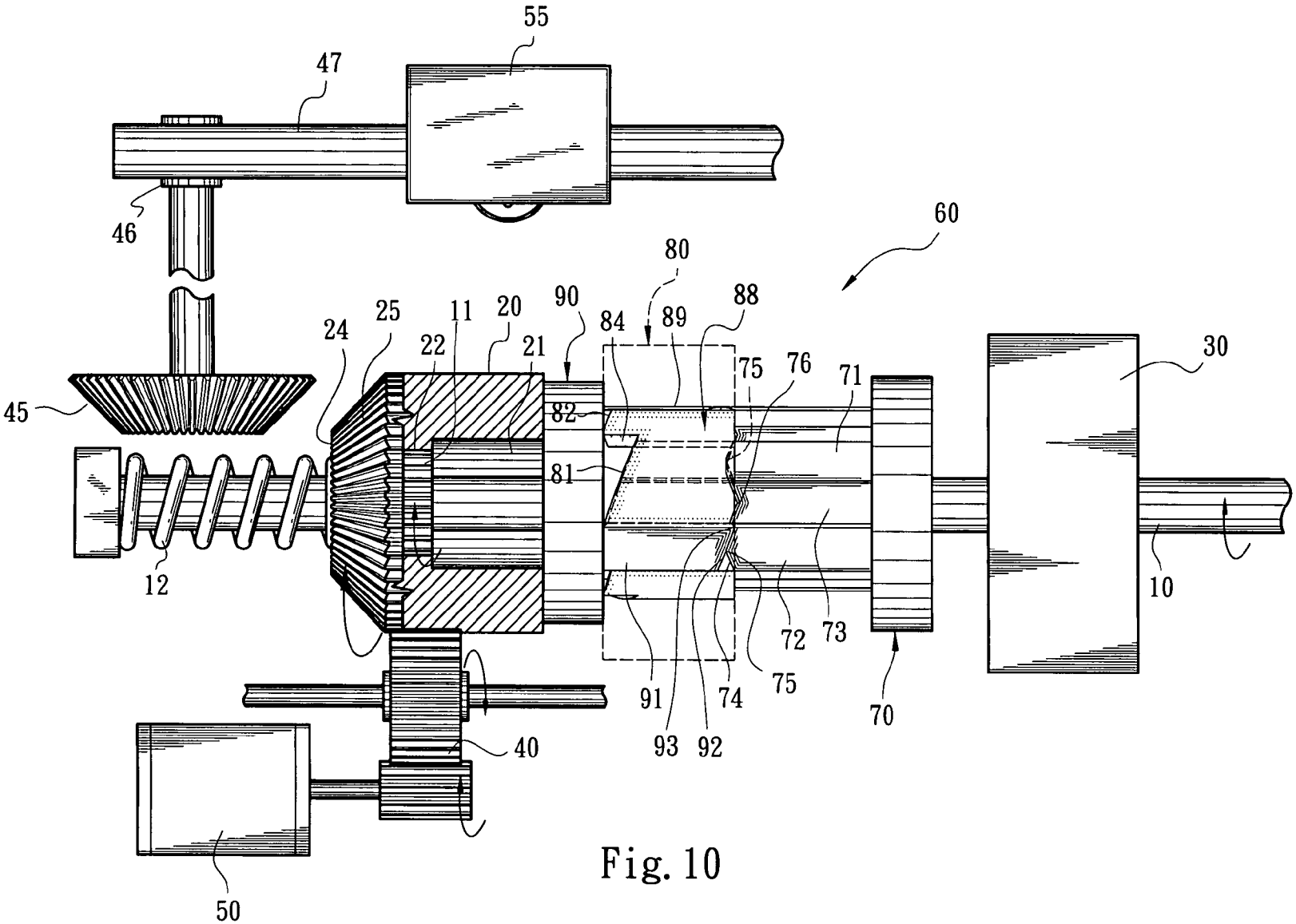
FIG. 10 is a sectional view of the second embodiment of the power transmission switching mechanism for office machine of the present invention, showing that the drive gear is engaged with the first gear of the rotary shaft.

FIGS. 9 and 10 show a position where the drive gear 20 drives and rotates the rotary shaft 10 to execute paper feeding and printing operations. FIG. 10 also shows a position of the shifter 60. In principle, the crests 75 or ridge sections 74 of the first section 70 are positioned in the seat body 80 in abutment with the slopes 92 and top ends 93 of the island blocks 91 of the second section 90. When the motor 50 operates, the power of the motor 50 is transmitted through the driving gear 40 and the internal spline 22 of the drive gear 20 to the first gear 11. Accordingly, the rotary shaft 10 will rotate to execute the paper feeding and printing operations.

Figure 11:
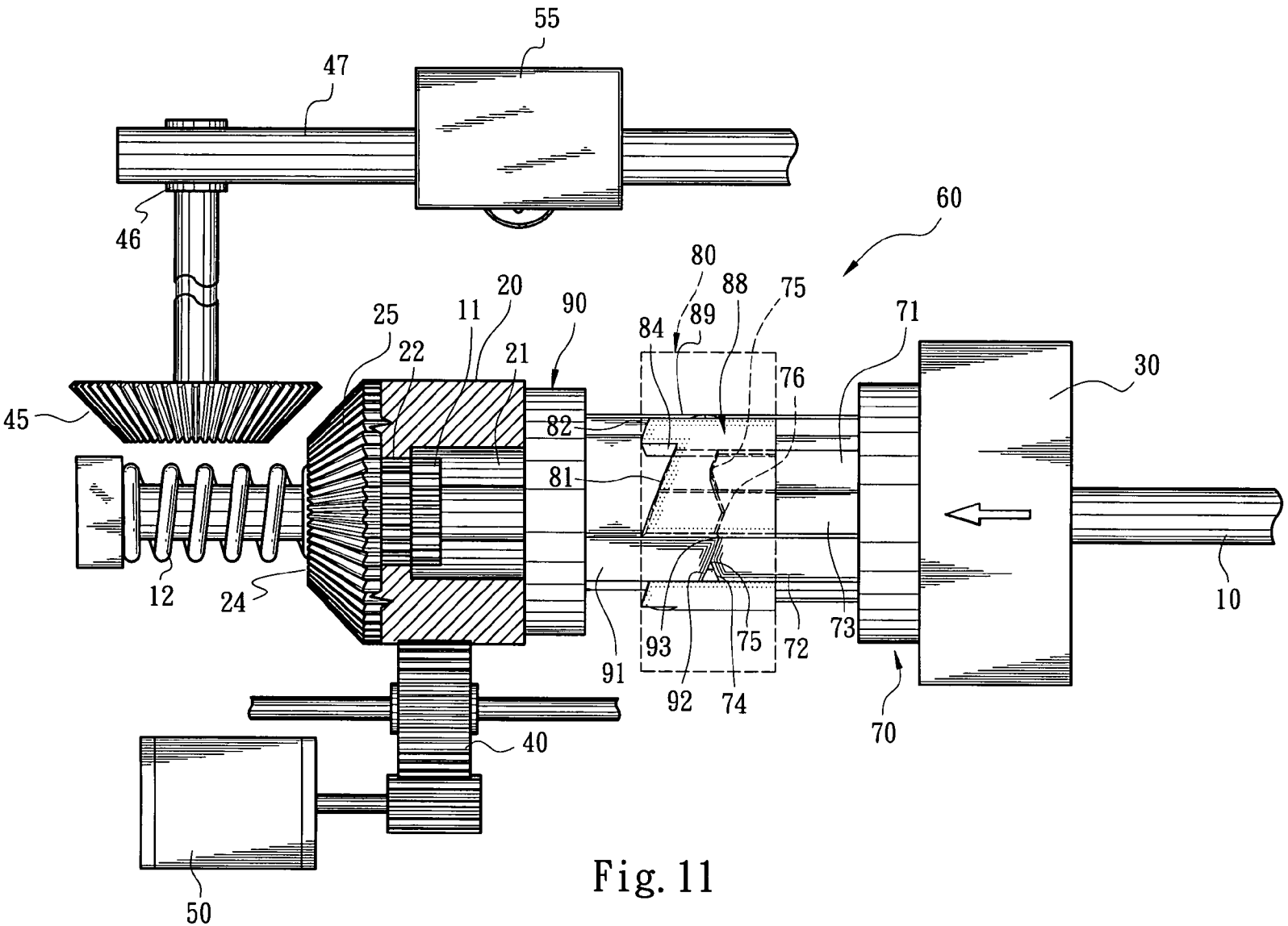
FIG. 11 is a sectional view according to FIG. 10, showing that the actuator is moved leftward.

Please refer to FIG. 11. In this embodiment, the motor 50 can be first turned off. When moving leftward, the actuator 30 pushes the first section 70 into the seat body 80. At this time, the island blocks 72 push the island blocks 91 of the second section 90 to drive and move the second section 90 leftward. Accordingly, the drive gear 20 is moved leftward to make the second gear section 25 engaged with the driven gear 45. Simultaneously, the rear end face 24 of the drive gear 20 compresses the spring 12 to conserve energy. As shown in FIG. 11, when the drive gear 20 is moved leftward, the first gear 11 of the rotary shaft 10 is disengaged from the internal spline 22 of the drive gear 20.

Figure 12:
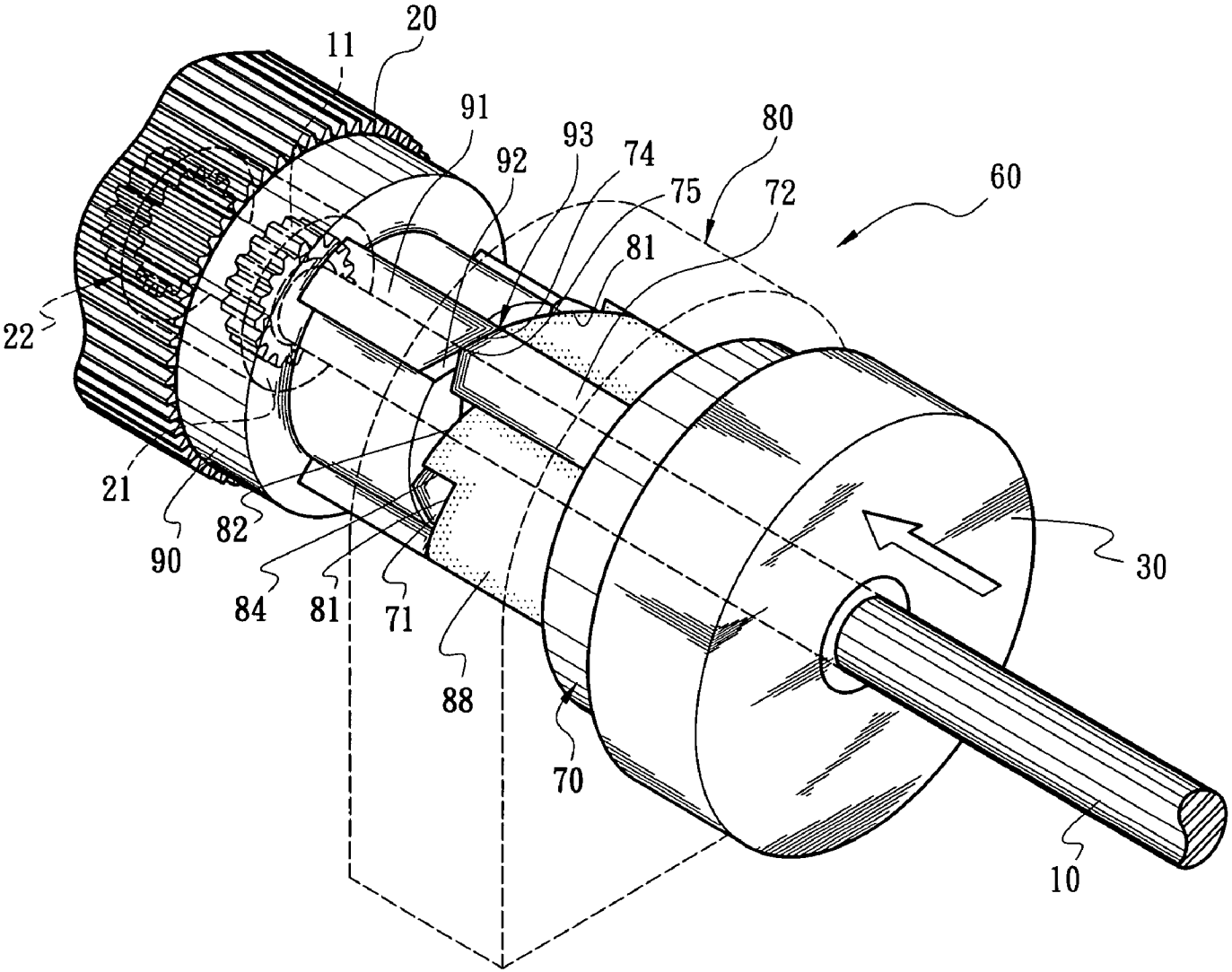
FIG. 12 is a perspective view of a part of the second embodiment of the power transmission switching mechanism for office machine of the present invention according to FIG. 11.
Figure 13:
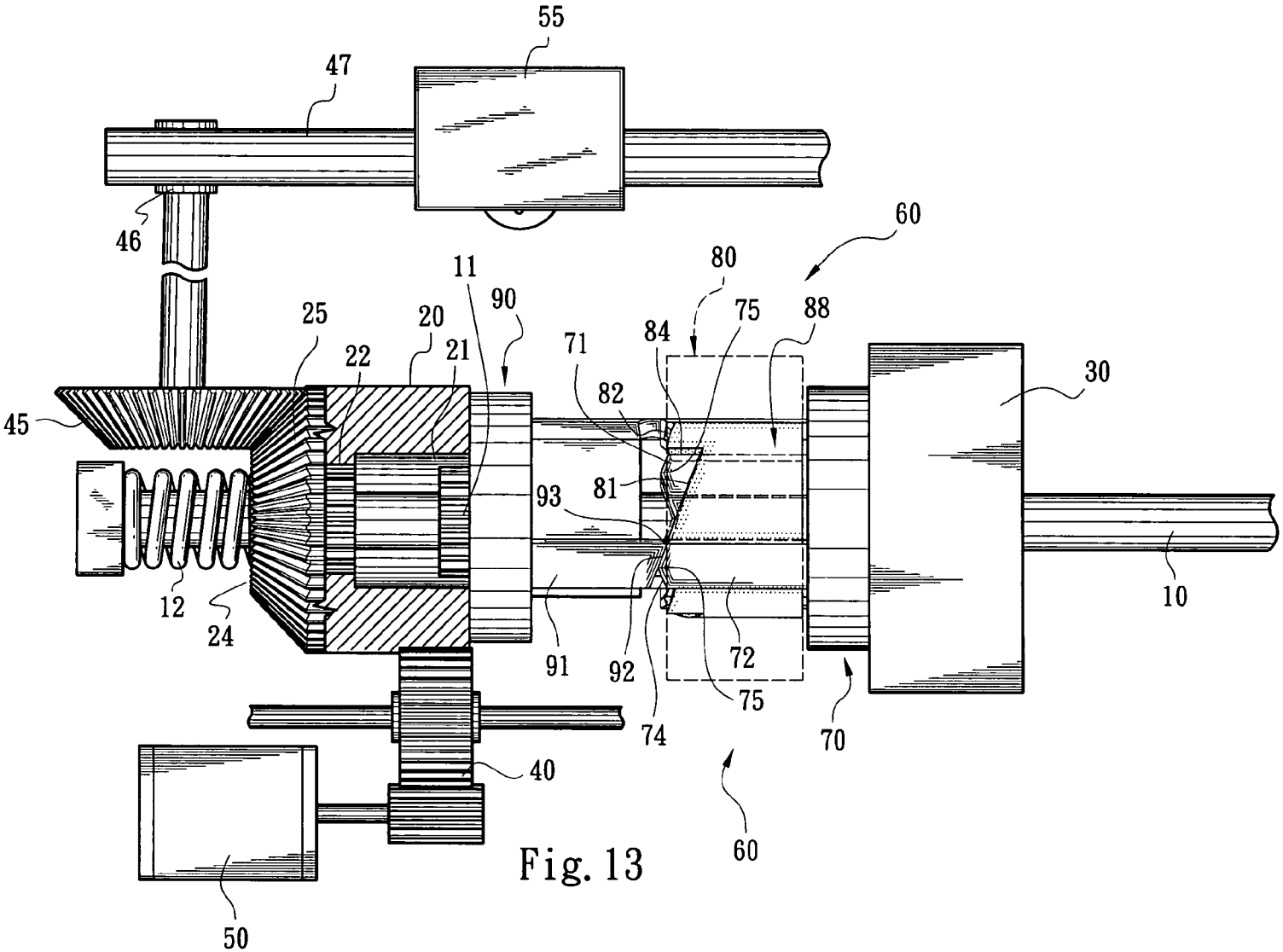
FIG. 13 is a sectional view according to FIG. 11, showing that the actuator is moved to a leftmost position.
Figure 14:
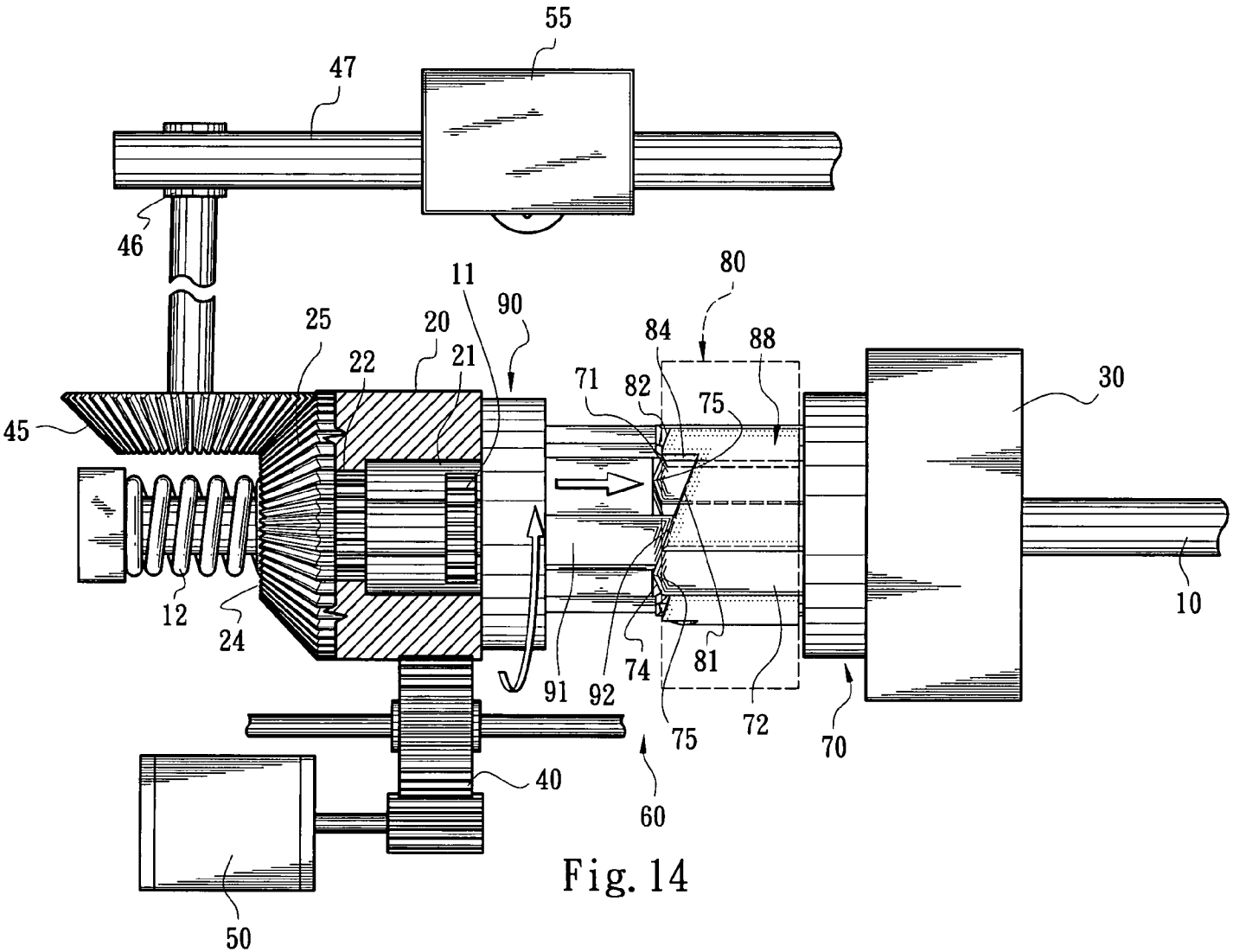
FIG. 14 is a sectional view according to FIG. 13, showing that the island block of the second section of the shifter moves along the first face of the interference section.
Figure 15:
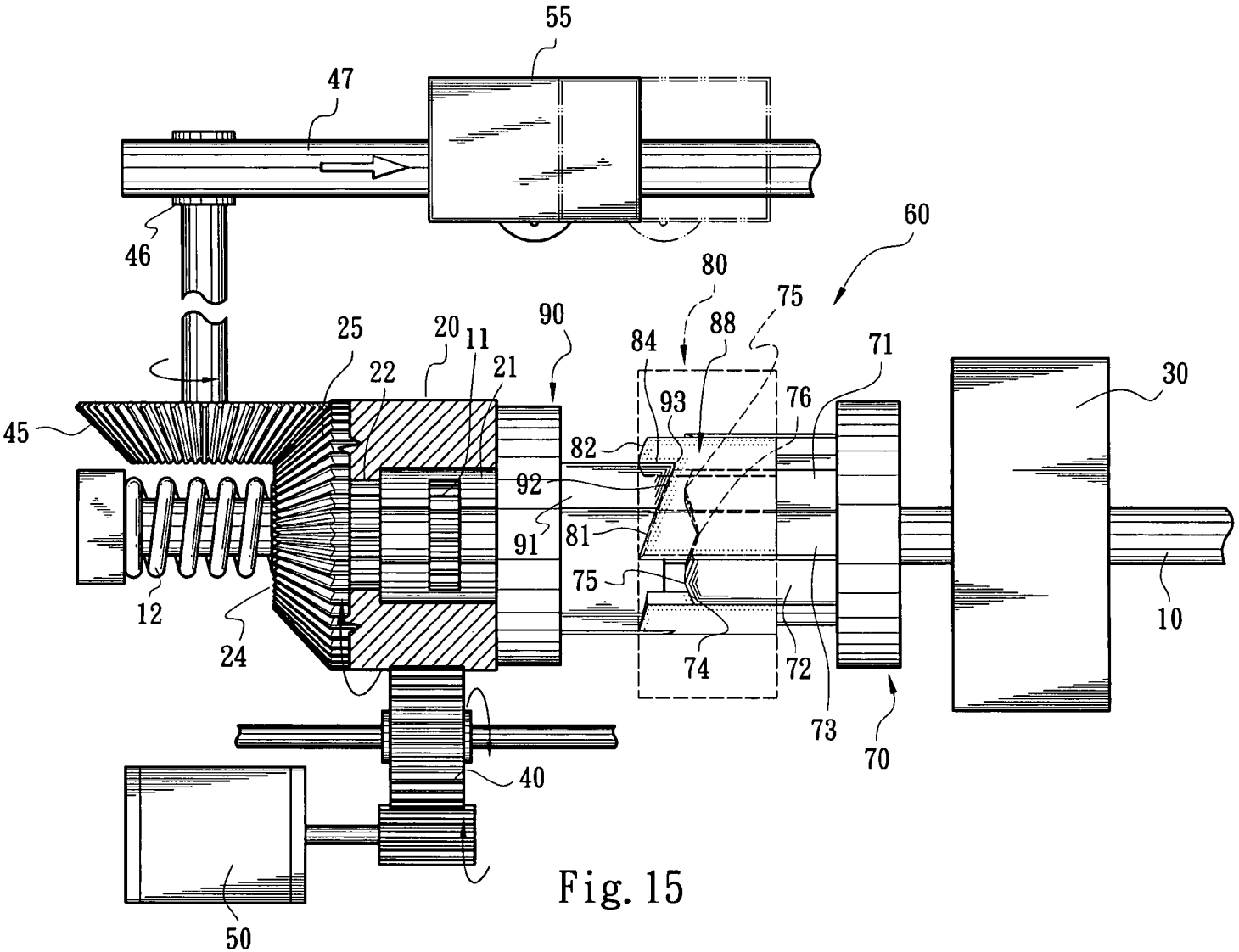
FIG. 15 is a sectional view according to FIG. 14, showing that the island block of the second section of the shifter is stopped by the shoulder section of the interference section.
Figure 16:
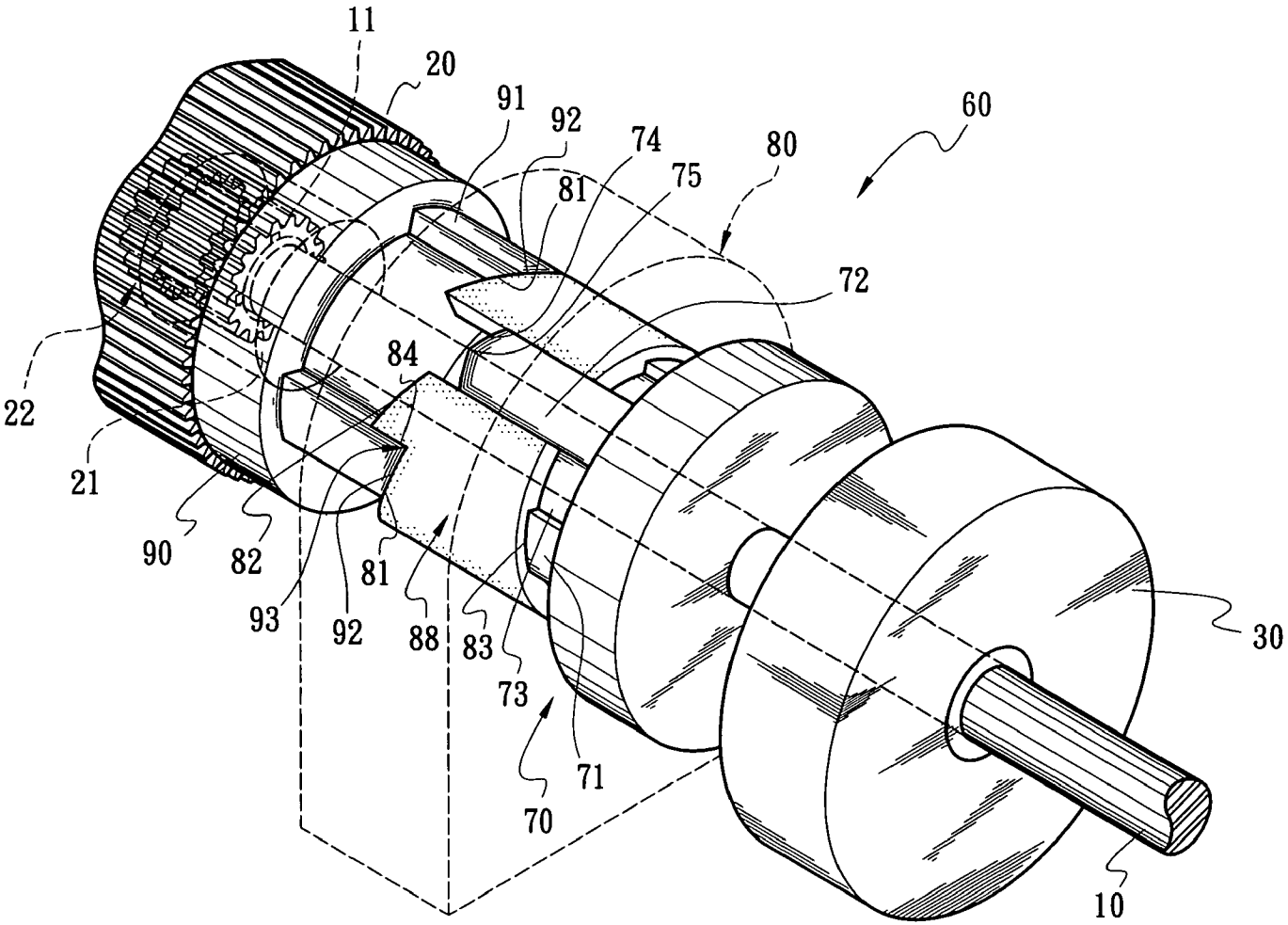
FIG. 16 is a perspective view of a part of the second embodiment of the power transmission switching mechanism for office machine of the present invention according to FIG. 15.

Please now refer to FIGS. 12 and 13, which show that the actuator 30 is moved to a leftmost position. At this time, the second section 90 is pushed by the first section 70 to a leftmost position. Under such circumstance, the slope 92 and the top end 93 of the island block 91 of the second section are positioned on the same line as the first face 81 of the interference section 88. After the actuator 30 moves to the leftmost position, the actuator 30 moves rightward away from the first section 70. At this time, the spring 12 will release the conserved energy to rightward push the drive gear 20 and the second section 90. At this time, as shown in FIG. 14, the slope 92 of the second section 90 will rotate and displace along the first face 81 of the interference section 88 until the island block 91 of the second section 90 is stopped by the shoulder section 84 of the interference section 88 as shown in FIGS. 15 and 16. At this time, the switching operation is completed and the second gear section 25 of the drive gear 20 is still engaged with the driven gear 45. Therefore, when the motor 50 operates, the power of the motor 50 is transmitted through the driving gear 40 and the second gear section 25 of the drive gear 20 to the driven gear 45. Then the power is transmitted through the pulley 46 to the belt 47 for driving the scanning module 55 to reciprocate and execute scanning operation. FIG. 16 specifically shows that when the island block 91 of the second section 90 is stopped by the shoulder section 84 of the interference section 88, the island block 91 is positioned on the same line as the pillow block 71 of the first section 70.

Figure 17:
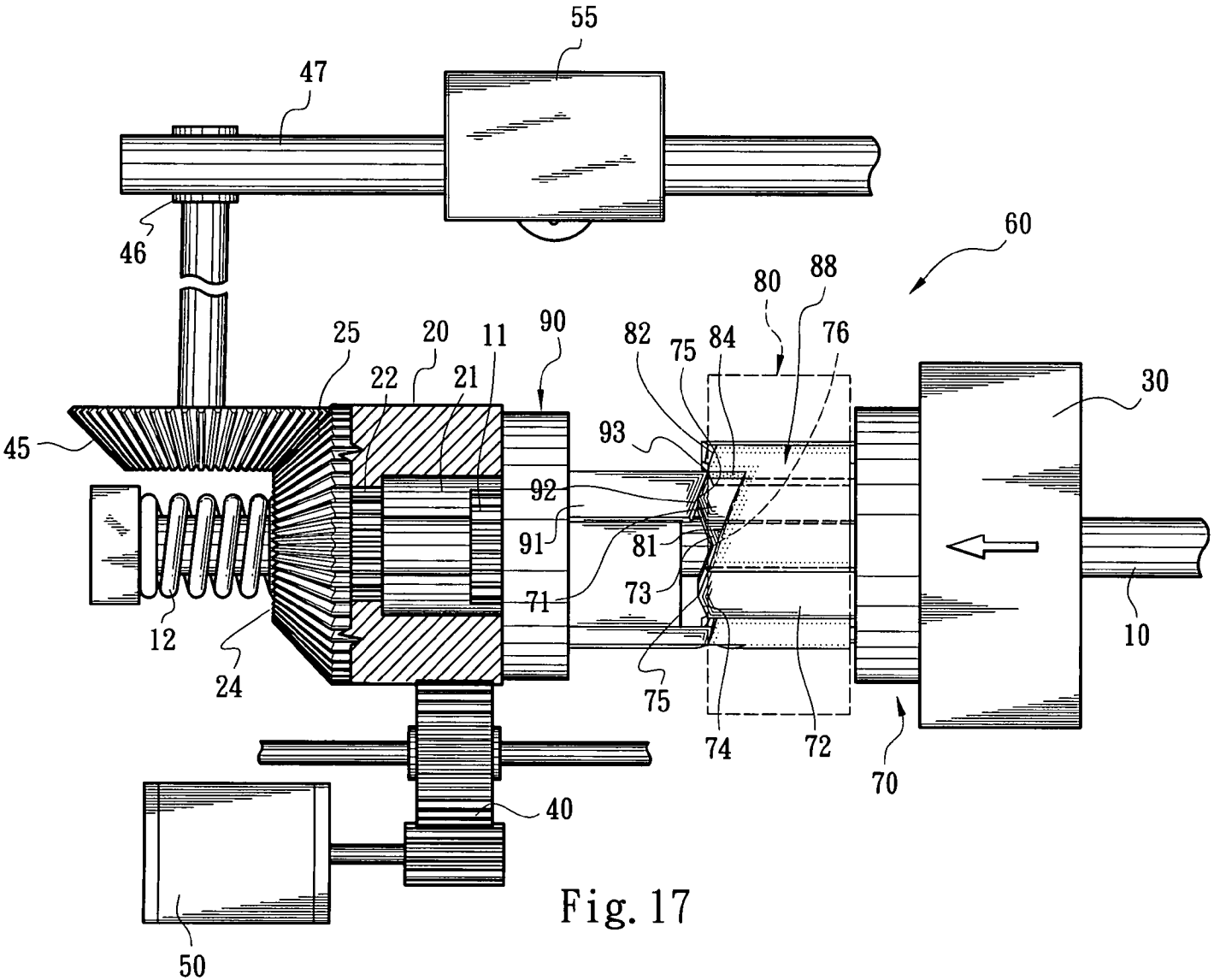
FIG. 17 is a sectional view of the second embodiment of the power transmission switching mechanism for office machine of the present invention, showing that the actuator is moved to a leftmost position.
Figure 18:
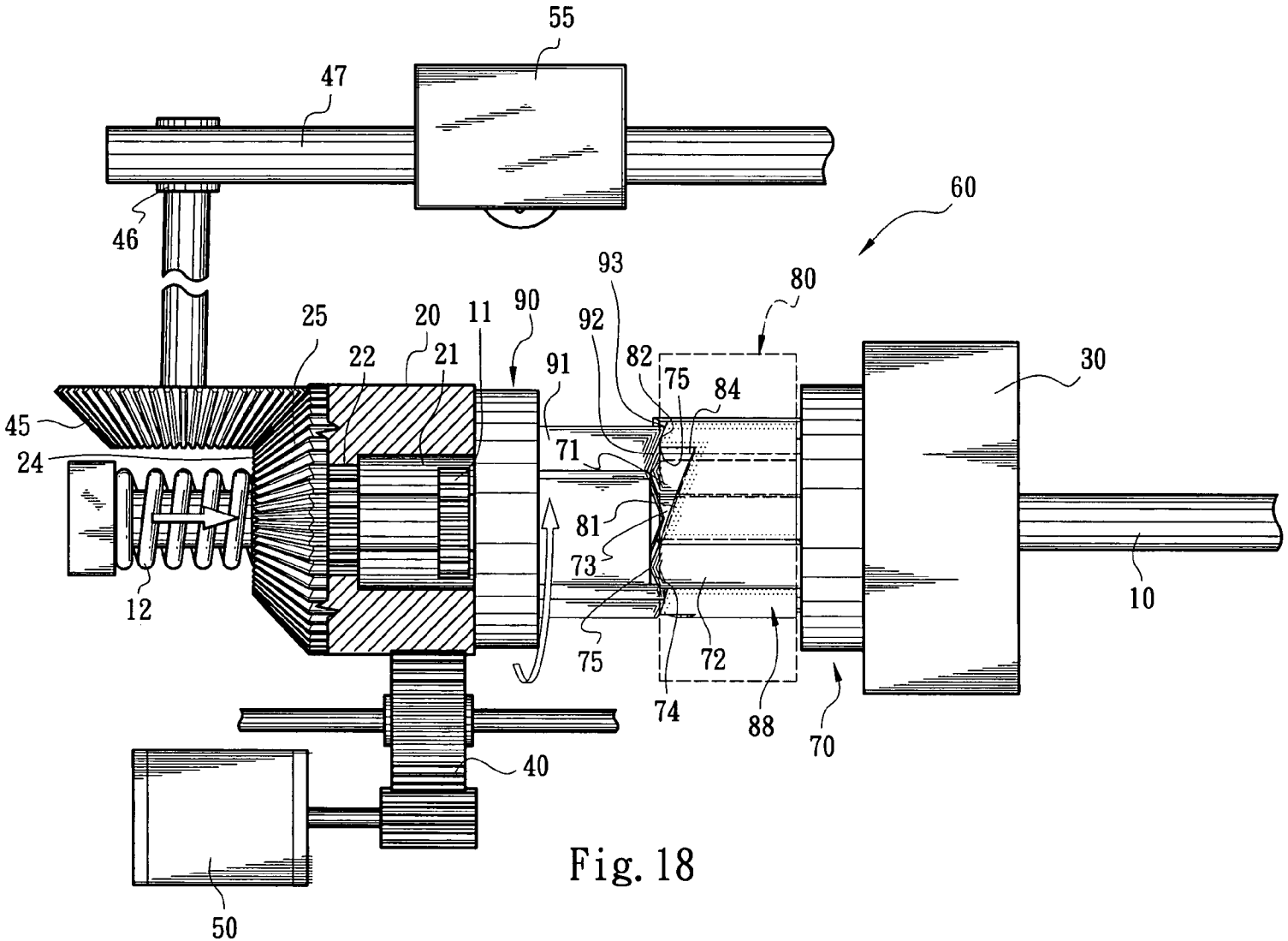
FIG. 18 is a sectional view according to FIG. 17, showing that the island block of the second section of the shifter moves along the second face of the interference section.
Figure 19:
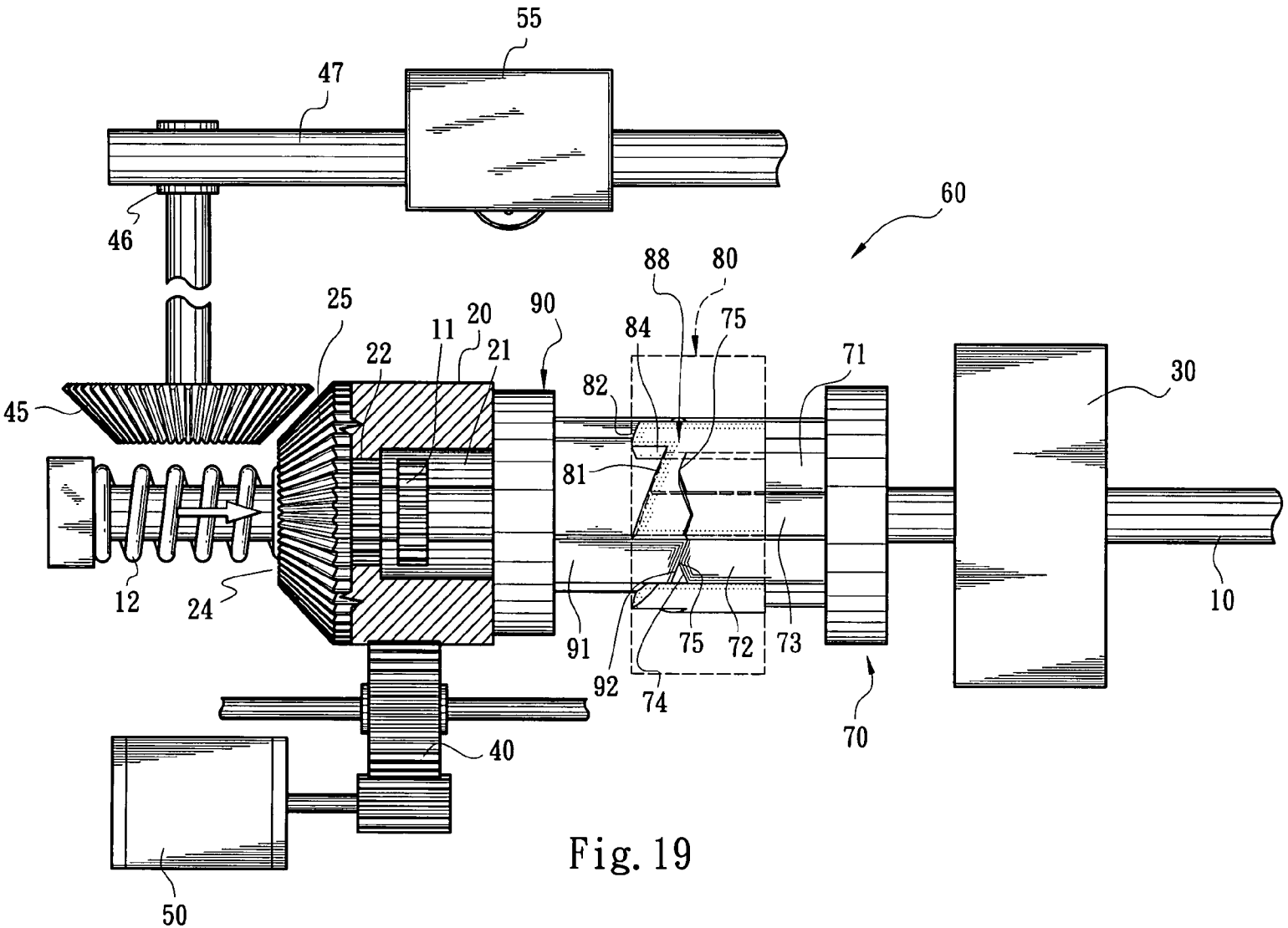
FIG. 19 is a sectional view according to FIG. 18, showing that the island block of the second section of the shifter enters the rail of the interference section.
Figure 20:
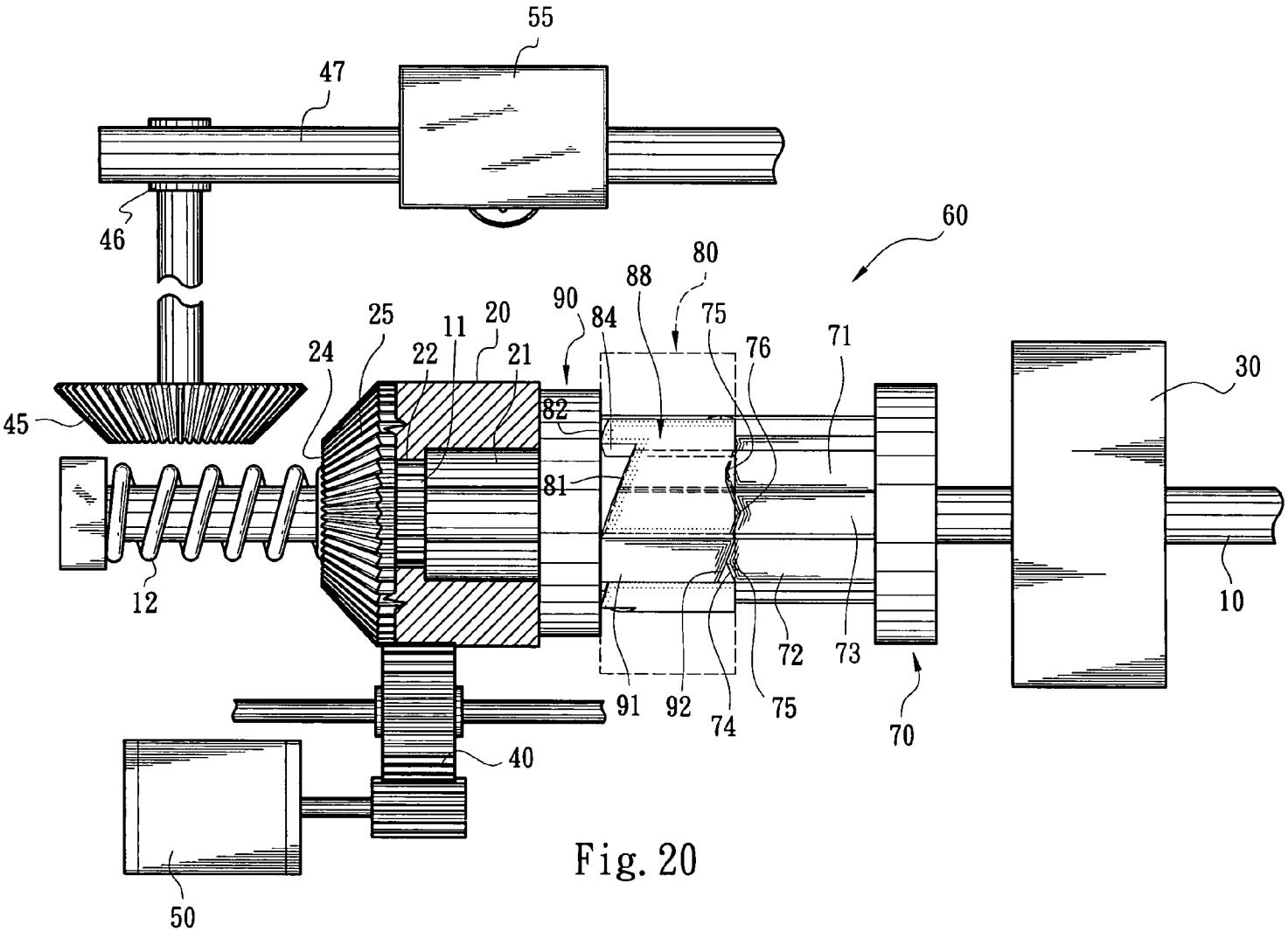
FIG. 20 is a sectional view according to FIG. 19, showing that the drive gear and the shifter are restored to their home positions.

Please now refer to FIG. 17. When a user desires to switch the power back, the user can operate and move the actuator 30 leftward again. At this time, the pillow block 71 of the first section 70 pushes the island block 91 to move leftward. FIG. 17 shows that the actuator 30 is moved to the leftmost position and the second section 90 is pushed by the first section 70 to the leftmost position. Under such circumstance, the slope 92 and the top end 93 of the island block 91 of the second section are positioned on the same line as the second face 82 of the interference section 88. After the actuator 30 moves to the leftmost position, the actuator 30 moves rightward away from the first section 70. At this time, the spring 12 will release the conserved energy to rightward push the drive gear 20 and the second section 90. At this time, as shown in FIG. 18, the slope 92 of the second section 90 will rotate and displace along the second face 82 of the interference section 88 until the island block 91 reaches the rail 87 between the interference sections 88. At this time, as shown in FIG. 19, the island block 91 will enter the rail 87 to push the island block 72 of the first section 70 in the rail 87 and move the first section 70 rightward back to its home position the same as the position shown in FIG. 10. At this time, the switching operation is completed as shown in FIG. 20.

According to the above arrangement, the power transmission switching mechanism for office machine of the present invention has less gears and simplified structure. By means of the power transmission switching mechanism, the motor 50 can be commonly used to execute scanning and printing operations. The power transmission switching mechanism includes a rotary shaft 10 having a first gear 11, a drive gear 20 mounted on the rotary shaft 10 and an actuator 30 reciprocally movable on the rotary shaft 10. The drive gear 20 has an internal spline 22. The actuator 30 can be selectively moved forward or backward to make the internal spline 22 disengaged from the first gear 11 or engaged therewith. Alternatively, a shifter 60 can be disposed between the actuator 30 and the drive gear 20. The shifter 60 includes a first section 70, a seat body 80 and a second section 90. The shifter 60 cooperates with the actuator 30 and the drive gear 20 to switch the power of the motor between the printing mode and the scanning mode.

The above embodiments are only used to illustrate the present invention, not intended to limit the scope thereof. Many modifications of the above embodiments can be made without departing from the spirit of the present invention.

What is claimed is:

1. A power transmission switching mechanism for office machine, comprising: a rotary shaft; a drive gear mounted on the rotary shaft; an actuator reciprocally movably mounted on the rotary shaft; a shifter positioned between the actuator and the drive gear, the shifter including a first section, a seat body and a second section, the first section being movably positioned between the actuator and the seat body, the second section being movably positioned between the seat body and the drive gear; a driving gear engaged with the drive gear for transmitting power of a motor to the drive gear; and a first gear mounted on the rotary shaft, whereby the drive gear can be selectively disengaged from the first gear or engaged therewith.

2. The power transmission switching mechanism for office machine as claimed in claim 1, wherein the first section is formed with a configuration like a hub, the first section having multiple pillow blocks and multiple island blocks, which extend along an axis of the first section, the pillow blocks and the island blocks defining multiple trenches therebetween.

3. The power transmission switching mechanism for office machine as claimed in claim 2, wherein each pillow block has a ridge section and a crest and each island block has a ridge section and a crest.

4. The power transmission switching mechanism for office machine as claimed in claim 2, wherein a trough is formed at a front end of each trench.

5. The power transmission switching mechanism for office machine as claimed in claim 1, wherein the seat body is formed with a through hole, at least one interference section being formed on a wall of the through hole.

6. The power transmission switching mechanism for office machine as claimed in claim 5, wherein multiple interference sections are formed on the wall of the through hole at intervals.

7. The power transmission switching mechanism for office machine as claimed in claim 5, wherein the interference section is formed with a channel.

8. The power transmission switching mechanism for office machine as claimed in claim 6, wherein each two adjacent interference sections define a rail therebetween.

9. The power transmission switching mechanism for office machine as claimed in claim 5, wherein the interference section at least has an irregular end face formed with a first face and a second face.

10. The power transmission switching mechanism for office machine as claimed in claim 9, wherein the second face is positioned at a length longer than that of a rear end of the first face, whereby a shoulder section is formed between the first and second faces.

11. The power transmission switching mechanism for office machine as claimed in claim 1, wherein the second section is formed with a configuration like a projecting shaft, the second section having at least one island block extending along an axis of the second section.

12. The power transmission switching mechanism for office machine as claimed in claim 11, wherein the island block has a slope and a top end.

13. The power transmission switching mechanism for office machine as claimed in claim 3, wherein the crest of the first section is positioned in the seat body in abutment with the second section.

14. The power transmission switching mechanism for office machine as claimed in claim 1, wherein the drive gear has a cavity and an internal spline formed in the cavity, whereby the internal spline can be selectively disengaged from the first gear or engaged therewith.

15. The power transmission switching mechanism for office machine as claimed in claim 1, wherein the drive gear includes a second gear section, a front end face and a rear end face, the front end face facing the actuator, the rear end face abutting against a spring.

16. The power transmission switching mechanism for office machine as claimed in claim 15, wherein the second gear section has a configuration of a bevel gear.

17. The power transmission switching mechanism for office machine as claimed in claim 15, wherein the second gear section is engaged with a driven gear, a pulley being connected to one end of the driven gear for driving a belt, which in turn drives a scanning module.

18. The power transmission switching mechanism for office machine as claimed in claim 17, wherein the second gear section has a configuration of a bevel gear.

* * * * *